US009352575B2

(12) United States Patent
Suzuki

(10) Patent No.: US 9,352,575 B2
(45) **Date of Patent: *May 31, 2016**

(54) METHOD OF SUPPLYING FLUID TO A FLUID EJECTION HEAD, FLUID SUPPLY MECHANISM, AND FLUID EJECTION DEVICE

(71) Applicant: Seiko Epson Corporation, Tokyo (JP)

(72) Inventor: Tomoji Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/733,099

(22) Filed: Jun. 8, 2015

(65) Prior Publication Data

US 2015/0266302 A1 Sep. 24, 2015

Related U.S. Application Data

(63) Continuation of application No. 14/195,208, filed on Mar. 3, 2014, now Pat. No. 9,056,480, which is a continuation of application No. 13/863,869, filed on Apr. 16, 2013, now Pat. No. 8,702,212, which is a continuation of application No. 13/303,583, filed on Nov. 23, 2011, now Pat. No. 8,444,258.

(30) Foreign Application Priority Data

Nov. 24, 2010 (JP) ..... 2010-260948

(51) Int. Cl.
*B41J 2/175* (2006.01)
*B41J 2/195* (2006.01)
*B41J 2/14* (2006.01)

(52) U.S. Cl.
CPC ..... *B41J 2/17506* (2013.01); *B41J 2/1433* (2013.01); *B41J 2/17509* (2013.01); *B41J 2/17556* (2013.01); *B41J 2/17596* (2013.01); *B41J 2002/17569* (2013.01)

(58) Field of Classification Search
CPC ..... B41J 2/17506; B41J 2/17509; B41J 2/17556; B41J 2/17596
USPC ..... 347/5, 7, 84, 85
See application file for complete search history.

(56) References Cited

U.S. PATENT DOCUMENTS 5,172,821 A 12/1992 Knopf
6,082,851 A 7/2000 Shihoh et al.

(Continued)

FOREIGN PATENT DOCUMENTS

EP 2 165 836 A2 3/2010
JP 11-227220 A 8/1999

(Continued)

OTHER PUBLICATIONS

**European Search Report Application No. 11189339, Dated Apr. 3, 2012.

*Primary Examiner* — Anh T. N. Vo
(74) *Attorney, Agent, or Firm* — Nutter McClennen & Fish LLP; John J. Penny, Jr.; Alex Nagorniy

(57) ABSTRACT

A drop in the throughput of continuous printing operations caused by refilling a subtank with ink is suppressed. The control unit of an inkjet printer 1 fills subtanks 11*a*-11*d* with ink whenever ink consumption exceeds a reference volume q during continuous printing. Ink is suctioned by producing negative pressure in subtanks 11*a*-11*d* during the ink refill operation while ink continues being supplied to the inkjet head 7 from pressure adjustment chambers 13*a*-13*d* disposed between subtanks 11*a*-11*d* and inkjet head 7. Ink ejection from the inkjet head 7 can therefore continue even during the ink ref ill operation. By setting the volume of the pressure adjustment chambers 13*a*-13*d* greater than at least the amount of ink that is ejected during the ink refill operation, there is no need to interrupt printing in order to replenish the ink supply.

7 Claims, 6 Drawing Sheets

(56) References Cited

U.S. PATENT DOCUMENTS

| | | | | |
|---|---|---|---|---|
| 6,109,741 | A | 8/2000 | Calatayud et al. | |
| 6,250,747 | B1 | 6/2001 | Hauck | |
| 6,334,658 | B1 | 1/2002 | Suzuki | |
| 6,390,611 | B1 | 5/2002 | Kobayashi et al. | |
| 6,783,215 | B2 | 8/2004 | Yoshida et al. | |
| 7,090,341 | B1 | 8/2006 | Miyazawa | |
| 7,287,842 | B2 | 10/2007 | Aruga | |
| 7,524,044 | B2 | 4/2009 | Kumagai | |
| 7,556,365 | B2 | 7/2009 | Stathem | |
| 7,648,230 | B2 * | 1/2010 | Kachi | B41J 2/17566 347/85 |
| 7,740,335 | B2 | 6/2010 | Miyamoto | |
| 7,878,632 | B2 * | 2/2011 | Kachi | B41J 2/17509 347/20 |
| 7,926,923 | B2 * | 4/2011 | Umeda | B41J 2/175 347/85 |
| 7,992,981 | B2 | 8/2011 | Yokouchi | |
| 8,100,519 | B2 | 1/2012 | Hirashima | |
| 8,444,258 | B2 | 5/2013 | Suzuki | |
| 8,702,212 | B2 | 4/2014 | Suzuki | |
| 9,056,480 | B2 * | 6/2015 | Suzuki | B41J 2/17509 |
| 2005/0134661 | A1 | 6/2005 | Miyazawa | |
| 2006/0098062 | A1 | 5/2006 | Miyazawa | |
| 2006/0284946 | A1 | 12/2006 | Miyazawa | |
| 2008/0079768 | A1 | 4/2008 | Kachi | |
| 2008/0151021 | A1 | 6/2008 | Miyazawa | |
| 2008/0303883 | A1 | 12/2008 | Miyazawa | |
| 2012/0127244 | A1 | 5/2012 | Suzuki | |
| 2013/0229468 | A1 | 9/2013 | Suzuki | |
| 2014/0176648 | A1 | 6/2014 | Suzuki | |

FOREIGN PATENT DOCUMENTS

| | | | |
|---|---|---|---|
| JP | 11-348300 | A | 12/1999 |
| JP | 2007-216568 | A | 8/2007 |
| JP | 2008-087286 | A | 4/2008 |
| JP | 2008-296509 | A | 12/2008 |
| JP | 2009-143066 | A | 7/2009 |
| JP | 2010-000626 | A | 1/2010 |
| JP | 2010-069845 | A | 4/2010 |
| JP | 2010-143050 | A | 7/2010 |

* cited by examiner

METHOD OF SUPPLYING FLUID TO A FLUID EJECTION HEAD, FLUID SUPPLY MECHANISM, AND FLUID EJECTION DEVICE

Priority is claimed under 35 U.S.C. §120 to U.S. patent application Ser. No. 14/195,208, filed Mar. 3, 2014, Ser. No. 13/863,869, filed Apr. 16, 2013, now U.S. Pat. No. 8,702,212, issued Apr. 22, 2014, Ser. No. 13/303,583, filed Nov. 23, 2011, now U.S. Pat. No. 8,444,258, issued May 21, 2013, and under 35 U.S.C. §119 to Japanese Priority Application No. JP 2010-260948 filed on Nov. 24, 2010, which are hereby incorporated by reference in their entireties.

BACKGROUND

1. Technical Field

The present invention relates to a fluid supply mechanism, a method of supplying fluid to a fluid ejection head, and a fluid ejection device that suctions fluid from a main tank such as an ink cartridge to a subtank, and then supplies fluid from the subtank to the fluid ejection head.

2. Related Art

An ink supply system for an inkjet printer that has an ink cartridge or other main tank disposed on the printer frame, and a subtank mounted on a carriage with the inkjet head, supplies ink from the subtank to the main tank when printing, and refills the subtank with ink from the main tank while the inkjet head is parked at the home position, is known from the literature. Japanese Unexamined Patent Appl. Pub. JP-A-2010-626 teaches an inkjet printer that has this type of ink supply system.

The inkjet printer taught in JP-A-2010-626 supplies ink to the subtank using an ink pump having a diaphragm. This ink pump suctions ink by displacing the diaphragm with a rocking lever. When the inkjet head moves to the home position, the lever rocks such that the free end of the lever contacts a fixed member on the home position side, thereby lifting the diaphragm, increasing the capacity of the ink chamber, and suctioning ink. A self-sealing unit for blocking transmission of pressure fluctuations to the upstream side is disposed between the subtank and the inkjet head. When the inlet to the self-sealing unit is opened by negative pressure on the inkjet head side, ink is supplied from the subtank to the inkjet head through the self-sealing unit.

Performing the ink refill operation during printing when the regular flushing operation is performed in this ink supply system has also been proposed. Because there is no particular need to return the inkjet head to the home position in this case, the ink supply can be efficiently replenished without causing a drop in throughput. However, because the ink in the subtank is consumed before the regular flushing interval when printing a pattern that consumes a large amount of ink, the ink refill operation must be performed before the regular flushing operation and the printing operation is thus interrupted. More specifically, because an inkjet line head has many nozzles, ink consumption is great, and the possibility that the ink will be depleted before the regular flushing interval is great. Printing is thus interrupted more frequently and throughput drops.

SUMMARY

A fluid supply mechanism, method of supplying fluid to a fluid supply mechanism, and a fluid ejection device according to at least one embodiment of the invention can continue ejecting ink from the fluid ejection head even during the ink refill operation without needing to return the fluid ejection head to a fixed position when refilling the subtank with fluid.

A first aspect of at least one embodiment of the invention is a method of supplying fluid to a fluid ejection head using a fluid supply mechanism that suctions fluid from a main tank to a subtank, and supplies fluid from the subtank through a pressure adjustment chamber to the fluid ejection head, including steps of: performing a fluid refill operation for suctioning fluid from the main tank to the subtank when the fluid ejection volume from the fluid ejection head since the last time the subtank was refilled equals or exceeds a preset reference volume; performing a fluid ejection operation of the fluid ejection head while supplying fluid in the pressure adjustment chamber to the fluid ejection head when fluid is not being supplied from the subtank to the pressure adjustment chamber in the fluid refill operation; and performing a fluid ejection operation of the fluid ejection head when fluid is being supplied from the subtank to the pressure adjustment chamber by supplying fluid in the pressure adjustment chamber to the fluid ejection head while supplying fluid in the subtank to the pressure adjustment chamber.

At least one embodiment of the invention thus normally supplies fluid from the pressure adjustment chamber to the fluid ejection head while refilling the pressure adjustment chamber with fluid from the subtank, and can continue the fluid ejection operation while supplying fluid from the pressure adjustment chamber to the fluid ejection head while refilling the subtank even if the supply of fluid from the subtank stops. There is therefore no need to interrupt the fluid ejection operation in order to refill the subtank, and a drop in the throughput of the fluid ejection operation due to the fluid refill operation can be suppressed. Fluid ejection operations that eject a large amount of fluid can therefore be executed at high speed.

At least one embodiment of the invention can be applied to a configuration in which the fluid ejection head is an inkjet head, and the fluid is ink for printing. In this case, a printing operation can be performed using the inkjet head while supplying ink in the pressure adjustment chamber to the inkjet head when ink is not being supplied from the subtank to the pressure adjustment chamber to refill the subtank with ink, and a printing operation can be performed using the inkjet head when ink is being supplied from the subtank to the pressure adjustment chamber by supplying ink in the pressure adjustment chamber to the inkjet head while supplying ink in the subtank to the pressure adjustment chamber. Interrupting the printing operation to refill the subtank with ink is therefore not necessary, and a decrease in the throughput of print jobs in order to refill the ink supply can be suppressed.

Another aspect of at least one embodiment of the invention is a fluid supply mechanism including: a subtank for supplying fluid to a fluid ejection head; a pressure adjustment chamber disposed in a fluid path from the subtank to the fluid ejection head; a backflow prevention valve disposed to the fluid path on the upstream side of the pressure adjustment chamber; and a fluid refilling means for refilling the subtank with ink from a main tank; wherein the fluid refilling means is configured to produce negative pressure in the subtank during the fluid ejection operation of the fluid ejection head, and suction fluid from the main tank into the subtank; the pressure adjustment chamber can output fluid in the pressure adjustment chamber to the fluid ejection head side when fluid is not being supplied from the subtank; and the volume of the pressure adjustment chamber is greater than or equal to amount of fluid that is ejected from the fluid ejection head while the subtank is being refilled by the fluid refilling means.

This aspect of the invention enables executing the method of supplying fluid to a fluid ejection head described above. More specifically, the backflow prevention valve prevents fluid returning from the pressure adjustment chamber side to the subtank during the fluid refill operation, and enables suctioning fluid from the main tank side. In addition, because there is sufficient capacity in the pressure adjustment chamber, supplying fluid from the pressure adjustment chamber to the fluid ejection head can continue until the fluid refill operation ends, and the fluid in the pressure adjustment chamber will not be depleted during the fluid refill operation. Interrupting the fluid ejection operation for the fluid refill operation is therefore not necessary, and a decrease in the throughput of fluid ejection operations in order to refill the subtank with fluid can be suppressed.

In a fluid supply mechanism according to another aspect of at least one embodiment of the invention, the fluid refilling means includes a diaphragm that changes the volume of the subtank by displacing in the axial direction of the subtank; an elastically deformable member connected to the diaphragm; a lever, one end of which is connected to the diaphragm through the elastically deformable member, and which is supported rockably in a specific rocking direction pulling the diaphragm to the maximum capacity side of the subtank through the intervening elastically deformable member, and the opposite direction; a motor; and a pressure mechanism that pushes the other end of the lever in the specific rocking direction based on the output rotation of the motor.

This aspect of the invention enables executing the fluid refill operation at a desired time by driving the motor to increase the volume of the subtank, thereby creating negative pressure inside the subtank and suctioning fluid. Fluid can therefore be supplied to the subtank while continuing the fluid ejection operation.

When there is a plurality of subtanks, a diaphragm, elastically deformable member, and lever are disposed for each subtank, and the levers are all disposed to rock in the same direction. The pressure mechanism includes a pressure lever that is supported movably in a pushing direction that pushes the other end of all levers simultaneously in the specific rocking direction, and in the opposite direction, and a roller that moves along a circular path according to the output rotation of the motor and while moving pushes the pressure lever in the pushing direction. Plural levers can thus be rocked simultaneously by the pushing lever, and a pressure mechanism does not need to be provided for each subtank. The configuration of the fluid supply mechanism can therefore be simplified.

Further preferably, the fluid refilling means has an urging member that urges the diaphragm in the direction reducing the subtank volume. With this aspect of the invention ink in the subtank is pushed to the pressure adjustment chamber side when the tension working on the diaphragm is released after suctioning fluid into the subtank. The amount of fluid that was consumed during the fluid ejection operation can therefore be quickly added to the pressure adjustment chamber, and the pressure adjustment chamber can be restored to the original fluid volume.

Another aspect of at least one embodiment of the invention is a fluid ejection device including: a fluid ejection head; a main tank that stores fluid to be ejected from the fluid ejection head; a fluid path that connects the main tank and the fluid ejection head; and the fluid supply mechanism described above.

The fluid ejection device preferably also has a control unit that determines the fluid ejection volume from the fluid ejection head, compares the fluid ejection volume with a preset reference volume, and when the fluid ejection volume is greater than or equal to the preset reference volume, causes the fluid refilling means to supply fluid to the subtank. This aspect of the invention enables determining if the fluid refill operation is needed based on the amount of fluid ejected from the fluid ejection head, and based on this decision performs the fluid refill operation before the fluid in the subtank is depleted. The fluid ejection head can therefore eject fluid continuously.

When the fluid ejection head is an inkjet head, and the fluid is printing ink, the subtank can be refilled with ink while the inkjet head continues printing. Interrupting the printing operation to refill the subtank with ink is therefore not necessary, and a drop in print job throughput in order to replenish the ink supply can be suppressed.

Effect of the Invention

The invention enables continuing the fluid ejection operation by supplying fluid in the pressure adjustment chamber to the fluid ejection head while refilling the subtank with fluid. Interrupting the fluid ejection operation to refill the subtank with fluid is therefore not necessary, and a drop in the throughput of the fluid ejection operation in order to replenish the fluid supply can be suppressed. Fluid ejection operations that eject a large volume of fluid can therefore be performed at high speed.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of an inkjet printer, ink supply mechanism, and method of supplying ink to an inkjet head according to the present invention are described below with reference to the accompanying figures.

General Configuration of an Inkjet Printer

Figure 1:
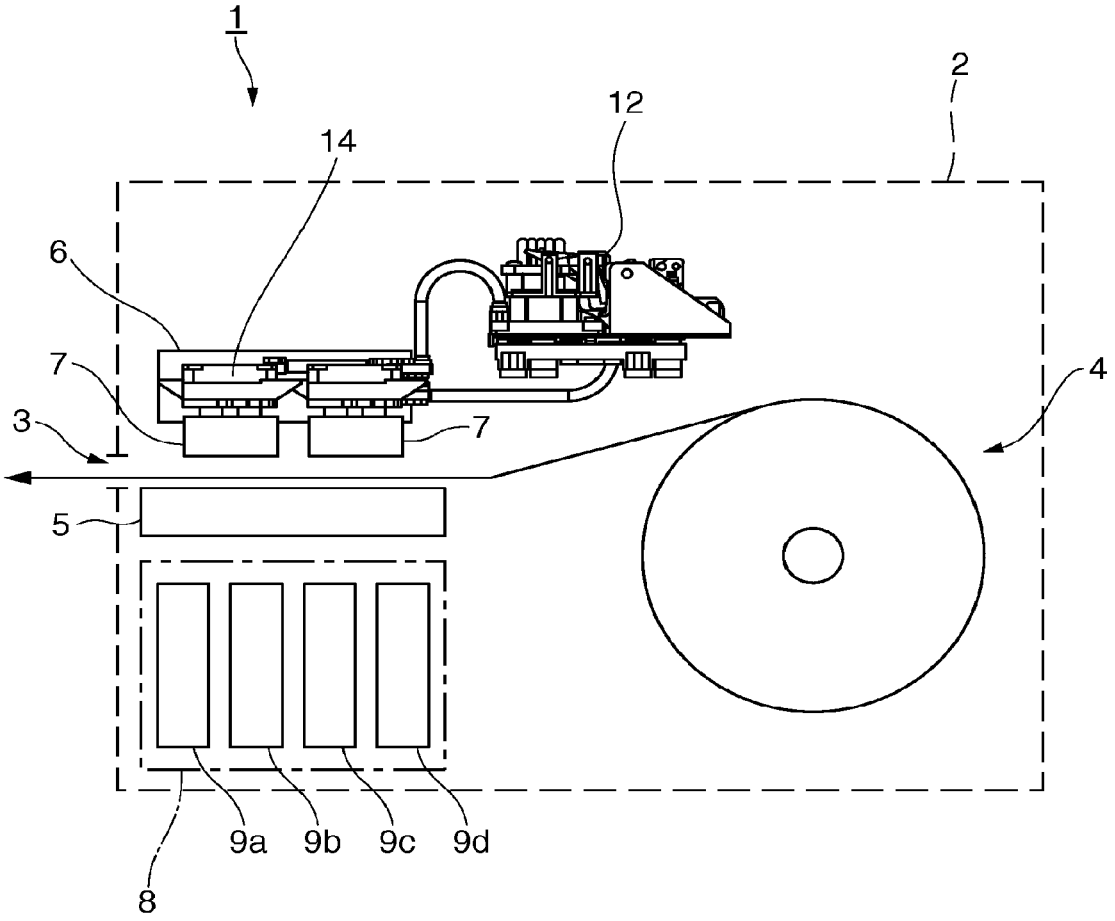
FIG. 1 schematically describes the configuration of an inkjet printer.

FIG. 1 schematically shows the configuration of an inkjet printer according to this embodiment of the invention. This inkjet printer 1 (fluid ejection device, referred to as printer 1 below) prints to a continuous web of recording paper delivered from a paper roll using plural colors of ink. The printer 1 has a basically rectangular printer case 2 and a paper exit 3 formed in the front of the printer case 2. A roll paper compartment 4 is disposed at a position toward the back of the printer inside the printer case 2. Recording paper pulled from the paper roll loaded in the roll paper compartment 4 is conveyed horizontally through a recording paper conveyance path past the surface of a platen 5 disposed near the back side of the paper exit 3.

A carriage 6 and inkjet head 7 (fluid ejection head) mounted thereon are disposed above the platen 5. The carriage 6 is supported movably up and down by a carriage guide mechanism not shown. The inkjet head 7 is disposed with the head surface in which the ink ejection nozzles are opened facing down. The inkjet head 7 can move based on the up and down movement of the carriage between a printing position where there is a specific gap between the head surface and the recording paper that passes over the platen 5 surface, and a retracted position to which the inkjet head 7 is removed above the printing position. The printer 1 conveys recording paper supplied from the paper roll by a recording paper conveyance mechanism not shown over the surface of the platen 5, and prints on the recording paper by ejecting ink from the inkjet head 7 in conjunction with conveyance of the recording paper.

An ink cartridge loading unit 8 is disposed below the platen 5. Ink cartridges 9*a*-9*d* (main tanks) that respectively store cyan, magenta, yellow, and black ink are installed to the ink cartridge loading unit 8. When the ink cartridges 9*a*-9*d* are installed in the ink cartridge loading unit 8, ink supply needles (not shown) that are disposed inside the ink cartridge loading unit 8 are inserted into ink supply inlets (not shown) that are disposed at the back ends of the ink cartridges 9*a*-9*d*. The ink cartridges 9*a*-9*d* are thus connected to the upstream end of the ink supply path 10 (FIG. 2) through which ink is supplied to the inkjet head 7.

A diaphragm pump unit 12 with subtanks 11*a*-11*d* that respectively store cyan, magenta, yellow, and black ink is disposed on the carriage 6 and inkjet head 7 at the end towards the back of the printer. A damper unit 14 with pressure adjustment chambers 13*a*-13*d* is disposed above the inkjet head 7.

Figure 2:
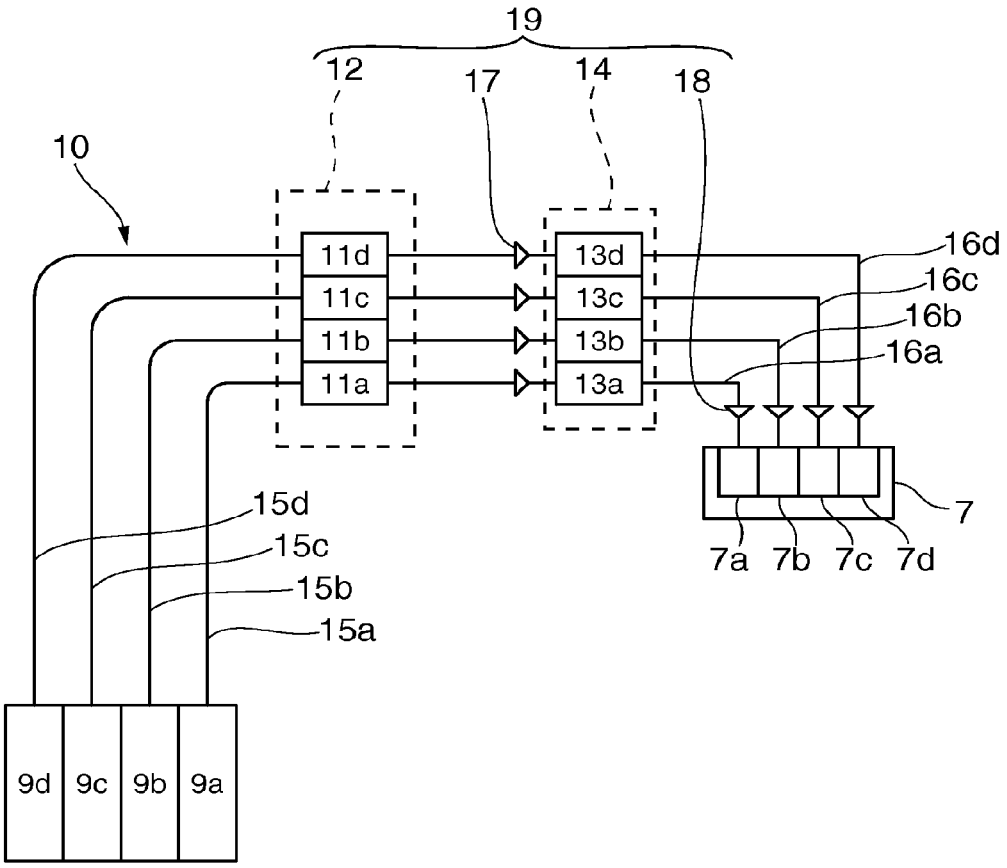
FIG. 2 schematically describes the ink supply system of the inkjet printer.

FIG. 2 schematically describes the ink supply system of an inkjet printer 1. The upstream side part of the ink supply path 10 is formed by four ink paths 15*a*-15*d* connecting the ink cartridges 9*a*-9*d* and the subtanks 11*a*-11*d*. Ink in the ink cartridges 9*a*-9*d* is suctioned through the ink paths 15*a*-15*d* to the subtanks 11*a*-11*d* by the ink suction operation of the diaphragm pump unit 12. The ink is stored inside the subtanks 11*a*-11*d* until it is fed to the inkjet head 7 side. The downstream side part of the ink supply path 10 is formed by four ink paths 16*a*-16*d* that connect the subtanks 11*a*-11*d* with the in-head paths 7*a*-7*d*.

The damper unit 14 is disposed in the ink paths 16*a*-16*d*. Ink stored in the subtanks 11*a*-11*d* passes the backflow prevention valve 17 and is supplied into the pressure adjustment chambers 13*a*-13*d* of the damper unit 14, and passes therefrom through another backflow prevention valve 18 and is supplied into the in-head paths 7*a*-7*d* of the inkjet head 7. An ink supply mechanism 19 (fluid supply mechanism) for supplying ink from the ink cartridges 9*a*-9*d* to the inkjet head 7 is thus formed by the diaphragm pump unit 12, damper unit 14, and the backflow prevention valves 17, 18 disposed in the ink paths therebetween.

Diaphragm Pump Unit and Damper Unit

Figure 3:
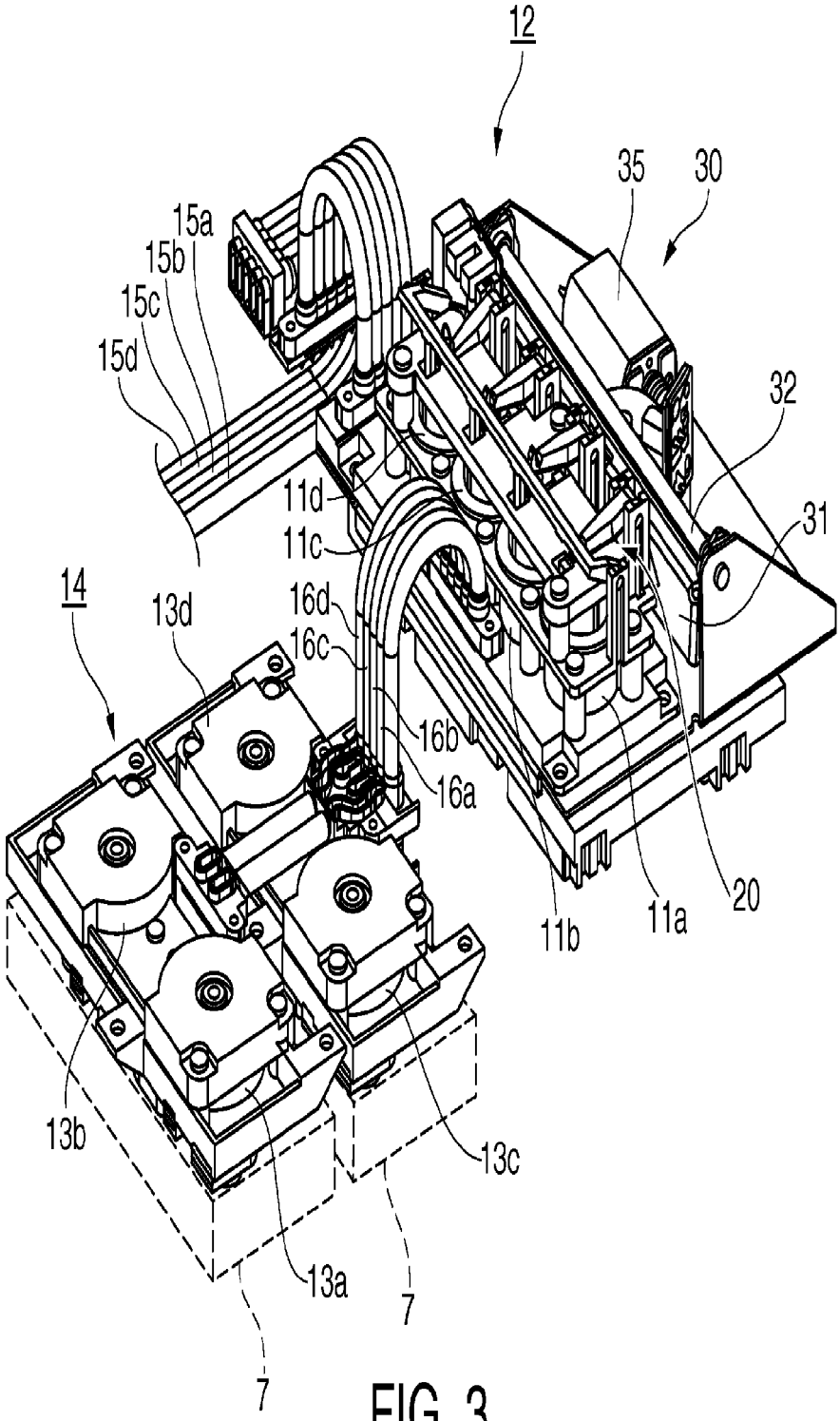
FIG. 3 is an oblique view of the diaphragm pump unit and damper unit.
Figure 4:
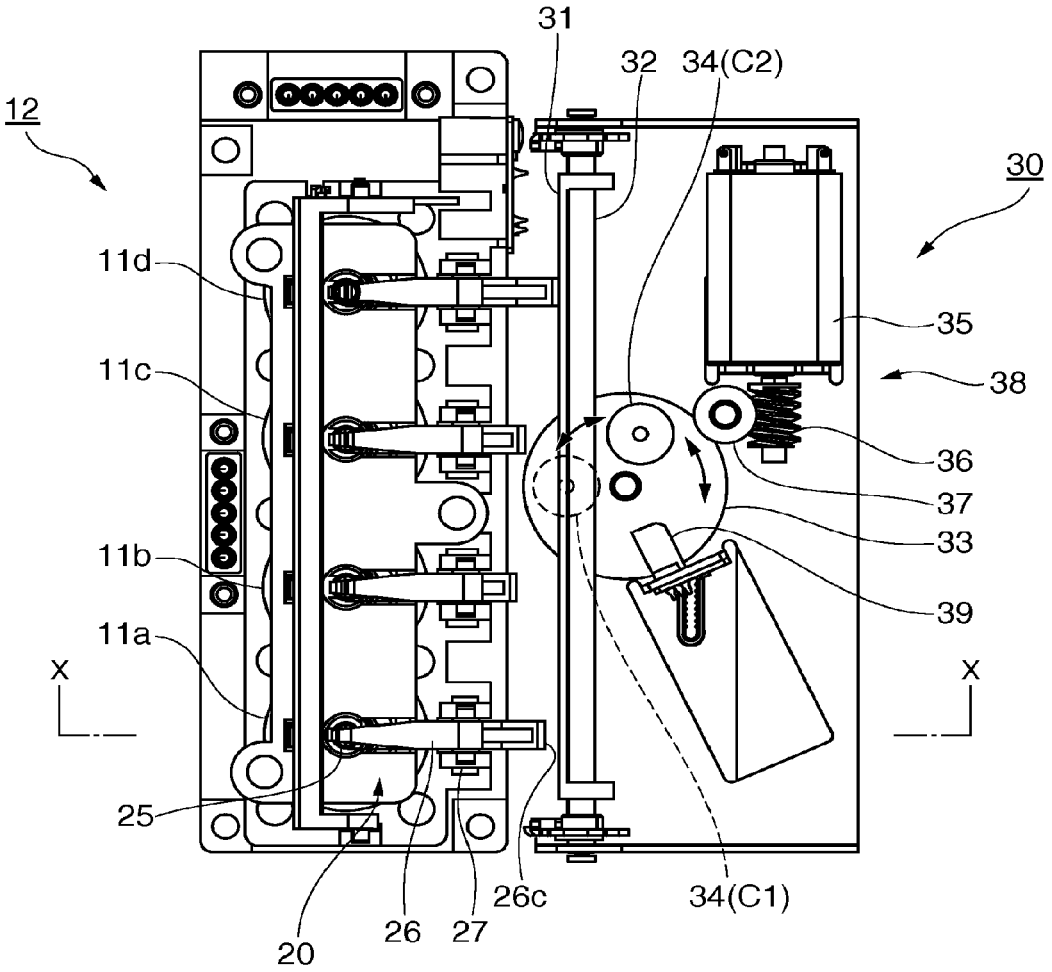
FIG. 4 is a plan view of the diaphragm pump unit.
Figure 5:
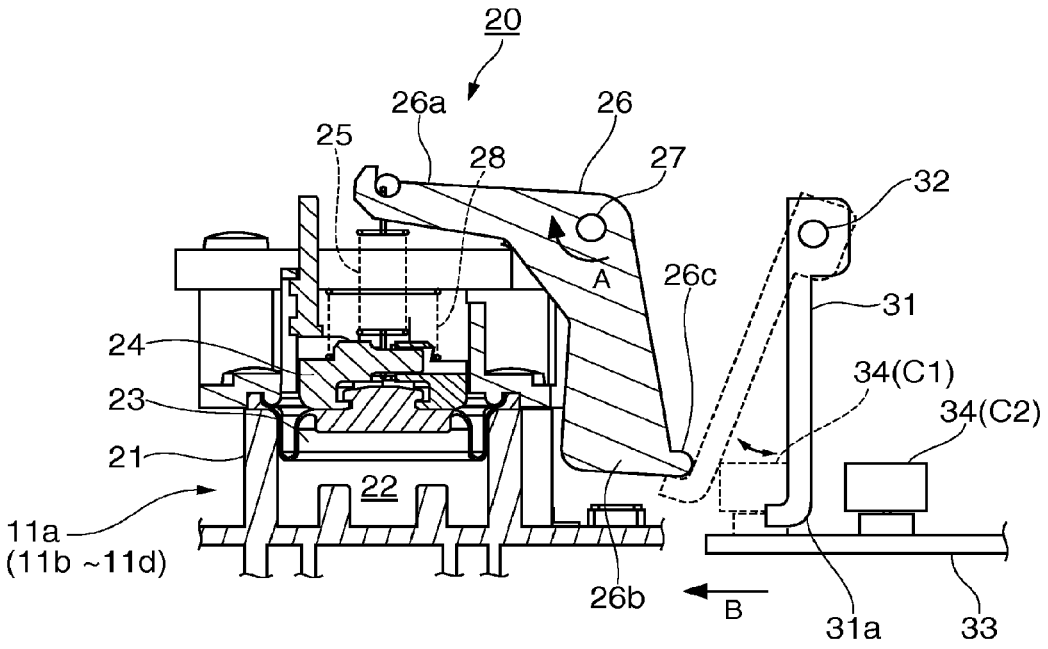
FIG. 5 is a section view (through line X-X in FIG. 4) of the main parts of the diaphragm pump unit.

FIG. 3 is an oblique view of the diaphragm pump unit 12 and damper unit 14. FIG. 4 is a plan view of the diaphragm pump unit 12, and FIG. 5 is a section view (through line X-X in FIG. 4) through the main parts of the diaphragm pump unit 12. As shown in FIG. 3, the diaphragm pump unit 12 is configured with an ink suction mechanism 20 (fluid refilling means) for suctioning ink into the subtanks 11*a*-11*d* disposed above the subtanks 11*a*-11*d*, and a drive mechanism 30 (fluid refilling means) for driving the ink suction mechanism 20 at a position adjacent to the subtanks 11*a*-11*d*.

As shown in FIG. 5, subtank 11*a* (11*b*-11*d*) has a cylindrical cylinder 21 that extends vertically, and an ink chamber 22 disposed in the bottom of the cylinder 21. A diaphragm 23 is attached to the cylinder 21 so that it closes the top of the ink chamber 22. A thick-walled portion is formed in the middle of the diaphragm 23, and a piston 24 that moves bidirectionally vertically inside the cylinder 21 is connected to this thick-walled portion.

The ink suction mechanism 20 includes the diaphragm 23 and piston 24 disposed inside the cylinder 21, a coil spring 25 (elastically displaceable member) attached to the top of the piston 24, and a suction lever 26 (lever) that extends from the top of the coil spring 25 and bends in an L-shape to the side of the cylinder 21. The suction lever 26 is supported rockably on a support pin 27 disposed above and to the rear of the printer from the cylinder 21.

The suction lever 26 includes a first arm part 26*a* that extends horizontally above the cylinder 21 from the support pin 27, and a second arm part 26*b* that extends down from the support pin 27. A hook is formed on the distal end of the first arm part 26*a*, and the top end of the coil spring 25 is attached to this hook. The distal end part 26*c* of the second arm part 26*b* protrudes away from the cylinder 21.

When the suction lever 26 is rocked in the rocking direction causing the first arm part 26*a* to rise (the direction indicated by arrow A in FIG. 5: specific rocking direction), the piston 24 connected thereto moves up and stretches the coil spring 25, and the diaphragm 23 is thus pulled up by the elastic restoring force of the coil spring 25. As a result, the volume of the ink chamber 22 increases and the inside of the ink chamber 22 goes to a negative pressure state, and ink is suctioned from the ink cartridge 9*a* (9*b*-9*d*) and supplied to the ink chamber 22. Because a backflow prevention valve 17 is disposed in the ink path 16*a* (16*b*-16*d*) connected to the pressure adjustment chamber 13*a* (13*b*-13*d*), ink backflow from the pressure adjustment chamber 13*a* (13*b*-13*d*) is prevented during the ink refill operation.

As shown in FIG. 4, the subtanks 11*a*-11*d* are arranged in a line, and four ink suction mechanisms 20 are similarly disposed in line with the subtanks 11*a*-11*d*.

The drive mechanism 30 has a pressure lever 31 (pressure member) disposed in a position opposite the distal end part of each of the four second arm parts 26*b* extending in the same direction. The pressure lever 31 is rockably supported on a support shaft 32 extending through the top ends of the levers. The drive mechanism 30 also has circular gear 33 supported freely rotatably below the pressure lever 31, and a roller 34 (drive member) that is attached near the outside circumference of the gear 33. A worm gear 36 connected to the output shaft of a motor 35, and a worm wheel 37 that meshes with the worm gear 36, are disposed in a position near the gear 33 so that the worm wheel 37 and gear 33 are engaged. The pressure lever 31, support shaft 32, gear 33, worm gear 36, and worm wheel 37 render a pressure mechanism 38 that pushes the second arm part 26*b* of the suction lever 26 according to the output rotation of the motor 35.

The output rotation of the motor 35 is transferred at a specific speed reducing ratio to this gear 33 through the worm gear 36 and worm wheel 37. When the gear 33 turns, the roller 34 disposed to the periphery thereof moves along a circular path. By controlling rotation of the motor 35, the roller 34 can be moved between a drive position C1 where it is closest to the suction lever 26, and a retracted position C2 rotated 90 degrees clockwise from the drive position C1. As a result, a sensor 39 for detecting the rotational position of the gear 33 is disposed to the gear 33.

When the roller 34 moves from the drive position C1 to the retracted position C2, it contacts the bottom end 31*a* of the pressure lever 31, and causes the pressure lever 31 to rock so that the bottom end 31*a* moves to the second arm part 26*b* side (in the direction of arrow B in FIG. 5). At this time the pressure lever 31 pushes the distal end part 26*c* of the second arm part 26*b* of the suction lever 26 to the cylinder 21 side, and forces the suction lever 26 to rock in the direction of arrow A. Because the suction lever 26 is held with the first arm part 26*a* raised to the highest position using the pressure lever 31 when the roller 34 is held at drive position C1, ink is supplied into the ink chamber 22. If the roller 34 returns to the retracted position C2 when ink filling is completed, the pressure lever 31 and suction lever 26 can move from where they are held by the roller 34.

The diaphragm pump unit 12 also has a pressure spring 28 (urging member) attached to the top of each piston 24. The pressure spring 28 is attached on the outside circumference side of the coil spring 25, and urges the diaphragm 23 down using the piston 24. When the roller 34 returns to the retracted position C2 after the refilling the ink chamber 22 with ink is completed, the suction lever 26 is released from where it is held so it can rock freely, thereby allowing the diaphragm 23 to descend to a position at which the pressure of the pressure spring 28 and the ink pressure on the diaphragm 23 are balanced. Some of the ink drawn into the ink chamber 22 of the subtank 11*a* (11*b*-11*d*) is pushed into the ink path 16*a* (16*b*-16*d*), passes the backflow prevention valve 17, and is supplied to the pressure adjustment chamber 13*a* (13*b*-13*d*). The pressure adjustment chamber 13*a* (13*b*-13*d*) is thus refilled with ink.

Figure 6:
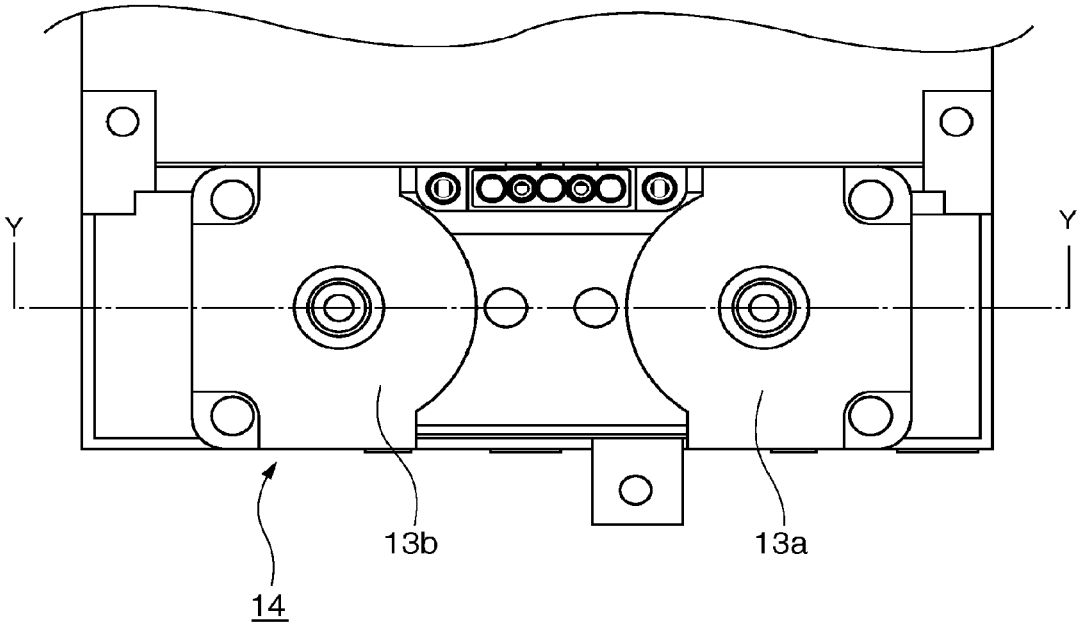
FIG. 6 is a partial plan view of the damper unit.
Figure 7:
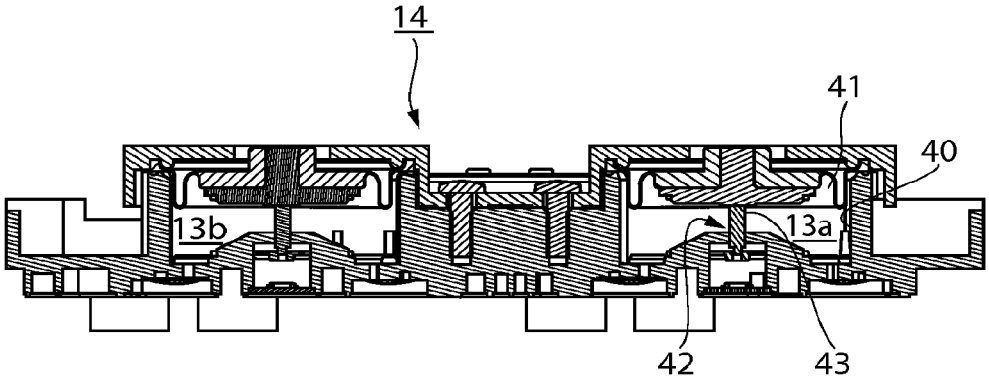
FIG. 7 is a section view of the damper unit through line Y-Y in FIG. 6.

FIG. 6 is a partial plan view of part of the damper unit 14, specifically the area around pressure adjustment chambers 13*a* and 13*b*. FIG. 7 is a section view of the damper unit 14 through line Y-Y in FIG. 6. The pressure adjustment chamber 13*a* (13*b*-13*d*) is formed with a cavity 40 of a specific volume with the top thereof covered by a diaphragm 41. An ink inlet 42 through which the subtank 11*a* (11*b*-11*d*) communicates with the ink path 16*a* (16*b*-16*d*) is formed in the bottom center of the cavity 40. The bottom end of a pressure adjustment spring 43 is attached to the ink inlet 42, and the top end of the pressure adjustment spring 43 is attached to the center of the bottom surface of the diaphragm 41. An ink outlet (not shown) is also disposed in the bottom of the pressure adjustment chamber 13*a* (13*b*-13*d*), and the pressure adjustment chamber 13*a* (13*b*-13*d*) and in-head path 7*a* (7*b*-7*d*) communicate through this ink outlet. The backflow prevention valve 18 (FIG. 2) is disposed in the ink outlet or the ink path downstream therefrom, and prevents ink backflow from the inkjet head 7 side.

When the amount of ink in the pressure adjustment chamber 13*a* (13*b*-13*d*) is low, the diaphragm 41 descends and the pressure adjustment spring 43 is compressed. The diaphragm 41 at this time is urged up by the elastic restoring force in the extension direction of the pressure adjustment spring 43. Therefore, when ink can be supplied from the subtank 11*a* (11*b*-11*d*), ink is suctioned from the ink inlet 42 and the amount of ink in the pressure adjustment chamber 13*a* (13*b*-13*d*) increases. When the amount of ink in the pressure adjustment chamber 13*a* (13*b*-13*d*) reaches a specific level, the ink pressure and elastic restoring force of the pressure adjustment spring 43 is balanced, a volume of ink corresponding to the outflow of ink from the pressure adjustment chamber 13*a* (13*b*-13*d*) to the in-head path 7*a* (7*b*-7*d*) is pulled in, and the volume of the pressure adjustment chamber 13*a* (13*b*-13*d*) remains constant. The elastic restoring force of the pressure adjustment spring 43 in this state alleviates sudden variations in the ink pressure on the upstream side of the pressure adjustment chamber 13*a* (13*b*-13*d*).

The operation of the ink suction mechanism 20 and drive mechanism 30 creates negative pressure in the subtanks 11*a*-11*d*, and ink is not supplied from the subtank 11*a*-11*d* side while the subtanks 11*a*-11*d* are being refilled with ink. However, if ink is consumed on the inkjet head 7 side at this time, the diaphragms 41 and pressure adjustment springs 43 of the pressure adjustment chambers 13*a*-13*d* will move according to the negative pressure on the in-head path 7*a*-7*d* side, and ink will flow out to the in-head path 7*a*-7*d* side.

More specifically, this embodiment of the invention can continue the ink ejection operation of the inkjet head 7 for a period of time by supplying ink from the pressure adjustment chambers 13*a*-13*d* even when ink is not supplied from the subtanks 11*a*-11*d*.

This embodiment of the invention refills the subtanks 11*a*-11*d* with ink while printing, and sets the capacity of the pressure adjustment chambers 13*a*-13*d* so that the ink in the pressure adjustment chambers 13*a*-13*d* will not be depleted during the ink refill operation and the printing operation will not be interrupted because ink cannot be supplied to the inkjet head 7 while the subtanks 11*a*-11*d* are being refilled. More specifically, the time required to refill the subtanks (the time required for the roller 34 to move from the retracted position C2, pause at the drive position C1, and then return to the retracted position C2) is preset, the amount of ink ejected from the inkjet head 7 (the ink ejection volume during the ink refill operation) during this time is determined, and the capacity of the pressure adjustment chambers 13*a*-13*d* is set so that ink at least equal to this ink ejection volume can be continuously supplied.

Method of Supplying Ink to the Inkjet Head

Figure 8:
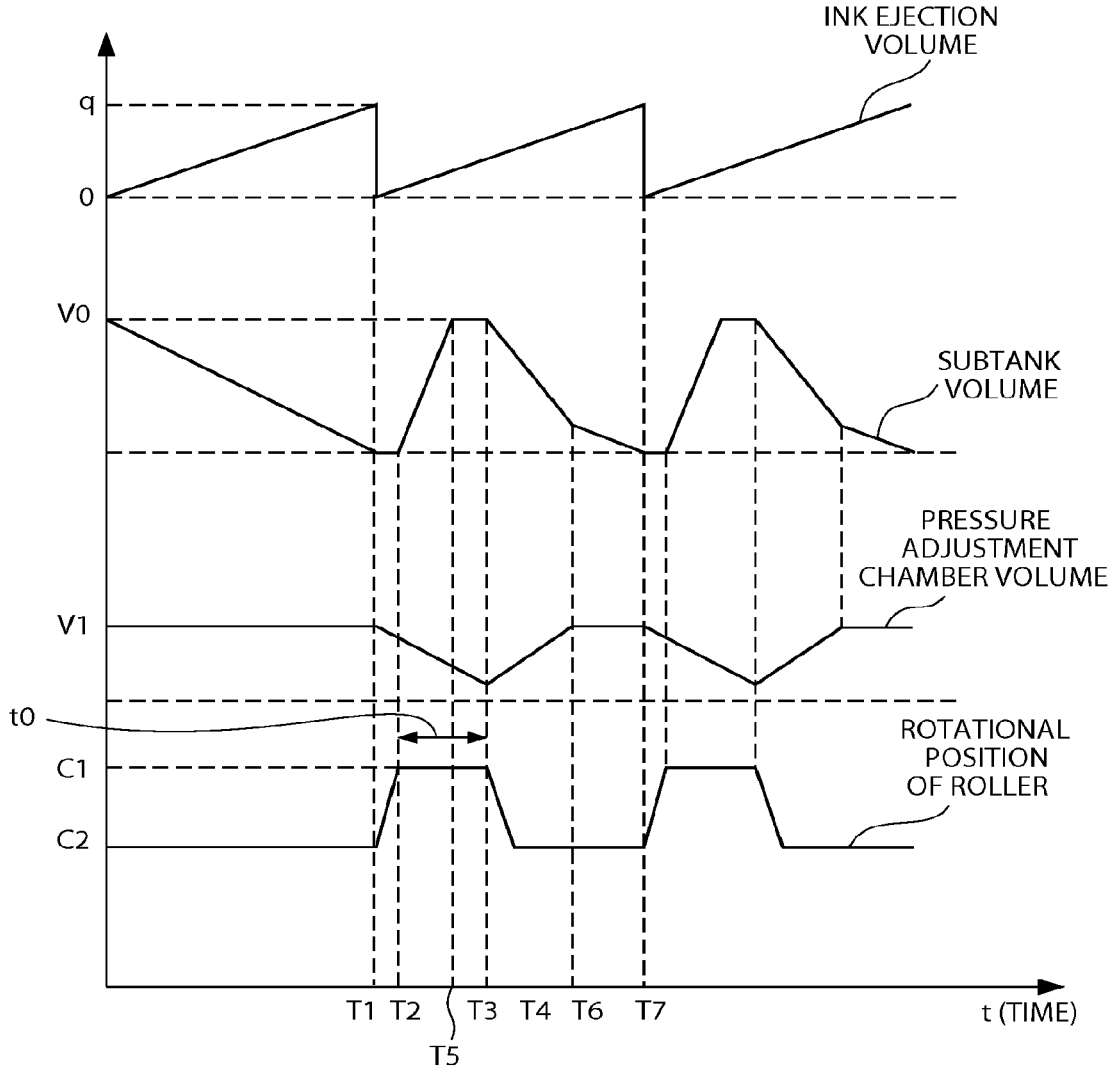
FIG. 8 is a timing chart of variation in the ink volume in the subtank and pressure adjustment chamber, and the roller rotation position, during continuous printing.

FIG. 8 is a timing chart showing the change in ink volume in the subtanks 11*a*-11*d* and the pressure adjustment chambers 13*a*-13*d* and the rotational position of the roller 34 during continuous printing. The control unit of the printer 1 monitors the amount of each color of ink that is ejected from the inkjet head 7 during the inkjet head 7 printing operation. This ink ejection volume can, for example, be determined from the print data, and the amount of each color of ink that was ejected after the last ink refill operation can be determined at any time while printing. The control unit of the printer 1 determines based on this ink ejection volume whether or not the subtanks 11*a*-11*d* must be refilled with ink. Note that how much of each color of ink has been ejected can be determined based on the ink ejection volume recorded in a semiconductor chip disposed to each ink cartridge 9*a*-9*d*.

When the ink ejection volume reaches a preset reference volume q (time T1 in FIG. 8), the control unit of the printer 1 determines that the subtanks 11*a*-11*d* must be refilled with ink. This embodiment of the invention uses four colors of ink, and determines that ink refilling is needed when the ink ejection volume of any color of ink equals or exceeds the reference volume q. The ink ejection volume corresponds to how much ink remains in the subtanks 11*a*-11*d*, and the capacity of the subtanks 11*a*-11*d* drops according to the reduction in the amount of remaining ink. The reference volume q of the ink ejection volume is set so that the ink in the subtanks 11*a*-11*d* will not be completely depleted. Whether ink refilling is needed can therefore be determined by detecting how much ink remains in the subtanks 11*a*-11*d* instead of detecting the ink ejection volume. [THIS SENTENCE APPEARS TO CONTRADICT THE SECOND SENTENCE OF THIS PARAGRAPH ("This embodiment of the invention uses four colors of ink, and determines that ink refilling is needed when the ink ejection volume of any color of ink equals or exceeds the reference volume q.")]

Based on determining at time T1 that the ink refill operation is needed, the printer 1 control unit starts filling the subtanks 11*a*-11*d* with ink. More specifically, the control unit starts forward rotation of the motor 35 of the drive mechanism 30 at this time. The motor 35 stops when the sensor 39 detects that the roller 34 reached the drive position C1 (time T2 in FIG. 8). As a result, the pressure lever 31 causes the suction lever 26 to rock, producing negative pressure inside each ink chamber 22 and starting suctioning ink from the ink cartridges 9*a*-9*d* using the ink suction mechanism 20. The printer 1 control unit resets the ink ejection volume simultaneously to starting the ink ref ill operation, and resumes monitoring the ink ejection volume to determine when to start the next ink refill operation.

The printer 1 control unit holds the roller 34 at the drive position C1 for a preset ink refill time t0, and during this time finishes suctioning ink into the subtanks 11*a*-11*d*. The motor 35 is then driven in reverse starting from the end of this ink refill time t0 (at time T3 in FIG. 8). The motor 35 is then stopped when the sensor 39 detects that the roller 34 returned to the retracted position C2 (at time T4 in FIG. 8). The ink refill operation thus ends.

The ink suction mechanism 20 and drive mechanism 30 start operating and the pressure inside the subtanks 11*a*-11*d* gradually decreases during the time from T1 to T2 in FIG. 8. Therefore, while a slight amount of ink continues to be supplied from the subtanks 11*a*-11*d* to the pressure adjustment chambers 13*a*-13*d* until a certain time during this period, the negative pressure in the subtanks 11*a*-11*d* then increases and ink supply to the pressure adjustment chambers 13*a*-13*d* stops. However, because ink supply to the inkjet head 7 continues, the capacity of the pressure adjustment chambers 13*a*-13*d* (the amount of ink in the pressure adjustment chambers 13*a*-13*d*) starts dropping in conjunction with the drop in ink supply from the subtanks 11*a*-11*d*.

During the period from T2 to T3 in FIG. 8 the ink suction mechanism 20 and drive mechanism 30 are completely switched to the ink refill state, and ink does not flow out from the subtanks 11*a*-11*d*. The volume of the subtanks 11*a*-11*d* therefore increases in conjunction with the increase in the ink volume in the subtanks 11*a*-11*d* during this time, and only ink from the pressure adjustment chambers 13*a*-13*d* is supplied to the inkjet head 7. As a result, the volume of the pressure adjustment chambers 13*a*-13*d* decreases in conjunction with ink outflow during this time. Inflow of ink to the subtanks 11*a*-11*d* stops when the subtanks 11*a*-11*d* reach a maximum capacity V0 (at time T5 in FIG. 8). By continuing the printing operation, the amount of ink in the pressure adjustment chambers 13*a*-13*d* drops as described above to time T3.

An operation that returns the ink suction mechanism 20 and drive mechanism 30 to the state before the ink refill operation is performed from T3 to T4 in FIG. 8. As the upward urging force of the coil spring 25 gradually decreases at this time, the pressure of the pressure spring 28 overcomes the force of the coil spring 25 at some point and urges the diaphragm 23 down, and thereby starts pushing ink suctioned into the subtanks 11*a*-11*d* out to the pressure adjustment chamber 13*a*-13*d* side. The volume in the subtanks 11*a*-11*d* therefore starts dropping at a certain time during this period, the drop in the amount of ink in the pressure adjustment chambers 13*a*-13*d* gradually declines, and the volume of ink in the pressure adjustment chambers 13*a*-13*d* starts to rise.

Some ink suctioned into the subtanks 11*a*-11*d* continues to be pushed into the pressure adjustment chambers 13*a*-13*d* by the pressure of the pressure spring 28 even after the ink refill operation ends at time T4 in FIG. 8. Increase in the volume of the pressure adjustment chambers 13*a*-13*d* then stops when the volume of the pressure adjustment chambers 13*a*-13*d* reaches the volume V1 before the ink refill operation starts (at time T6 in FIG. 8). The volume of the pressure adjustment chambers 13*a*-13*d* is thereafter held constant and the volume of ink in the subtanks 11*a*-11*d* decreases. More specifically, printing continues while ink in the subtanks 11*a*-11*d* is supplied through the pressure adjustment chambers 13*a*-13*d* to the inkjet head 7. This state continues until the printer 1 control unit detects that the ink ejection volume again reaches the reference volume q (at time T7 in FIG. 8).

As described above, the ink refill operation (fluid refill operation) that suctions ink into the subtanks 11*a*-11*d* in this embodiment of the invention moves the roller 34 of the drive mechanism 30 from the retracted position C2 to the drive position C1 and holds the roller 34 at the drive position C1 during the ink refill time to, and then returns the roller 34 to the retracted position C2, thereby producing negative pressure in the subtanks 11*a*-11*d* using the ink suction mechanism 20 and finishing filling the subtanks 11*a*-11*d* with ink. When ink cannot be supplied from the subtanks 11*a*-11*d* because of this ink refill operation, printing can continue by supplying ink from the pressure adjustment chambers 13*a*-13*d* to the inkjet head 7. Interrupting a continuous printing operation in order to refill the subtanks 11*a*-11*d* with ink is therefore not necessary, and a drop in the throughput of the printing operation caused by the ink refill operation can be prevented. Printing operations that consume a large amount of ink can therefore be performed at high speed.

Variation of the Embodiment

A configuration that moves the roller 34 along a curved path and thereby drives the pressure lever 31 is used as the drive mechanism 30 for driving the ink suction mechanism 20 in the embodiment described above, but other configurations that can cause the suction lever 26 to rock according to the rotational output of the motor 35 can be used instead.

Other Embodiments

The foregoing embodiment applies the invention to an printer 1, an ink supply mechanism 19 for supplying ink to the inkjet head 7 of the printer 1, and a method of supplying ink to the inkjet head 7, but the invention can also be applied to a other fluid ejection devices and fluid supply mechanisms that eject fluids other than ink, and to a method of supplying fluid to a fluid ejection head. For example, the invention can also be applied to a fluid ejection device for ejecting reagent solutions and fluid samples from a fluid ejection head, and to fluid ejection devices for forming printed coatings by ejecting fluid coatings or other fluid materials from a fluid ejection head.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A fluid ejection device comprising:

a fluid ejection head;

a first tank configured to store a first fluid and a second tank configured to store a second fluid said first and second fluid to be ejected from the fluid ejection head;

a first diaphragm pump configured to supply the first fluid to the fluid ejection head and a second diaphragm pump configured to supply the second fluid to the fluid ejection head; and a fluid refilling mechanism configured to refill the first and second diaphragm pumps with the fluids from the first and second ink tanks; wherein the fluid refilling mechanism comprises:

a first lever and a second lever configured to pull in a direction where capacity of a diaphragm is increased through an elastically deformable member; and a pressure lever that is rockably supported and configured to push one end of the first lever and one end of the second lever simultaneously, wherein the pressure member is configured to push the end of the levers to refill the first and second diaphragm pumps with the fluids from the first or second ink tanks.

2. The fluid ejection device described in claim 1, further comprising:

a pressure adjustment chamber disposed in a fluid path from the first or second diaphragm pump to the fluid ejection head; and a backflow prevention valve disposed in the fluid path on an upstream side of the pressure adjustment chamber.

3. The fluid ejection device described in claim 1, wherein:

the fluid refilling mechanism further comprising:

a diaphragm that changes a volume of the first or second diaphragm pump;

an elastically deformable member connected to the diaphragm;

the first lever and the second lever, an other end of each of the first or second levers is connected to the diaphragm through the elastically deformable member;

a motor;

a drive member that drives the pressure member according to an output rotation of the motor; and wherein the first and second levers are configured to move corresponding to an amount of the fluid in the first and second diaphragm pumps.

4. The fluid ejection device described in claim 3, wherein the drive member moves along a circular path according to an output rotation of the motor.

5. The fluid ejection device described in claim 1, further indicating:

an urging member that urges the diaphragm in a direction that reduces the diaphragm pump volume.

6. The fluid ejection device described in claim 1, further comprising:

a control unit that determines a fluid ejection volume from the fluid ejection head, compares a fluid ejection volume of the fluid ejection head with a preset reference volume, and when the fluid ejection volume is greater than or equal to the preset reference volume, causes the fluid refilling mechanism to supply the first or second fluid to the diaphragm pump.

7. The fluid ejection device described in claim 1, wherein:

the fluid ejection head is an inkjet head;

and the first fluid and the second fluid are printing ink.

* * * * *